US009903164B2

(12) United States Patent
Cox

(10) Patent No.: US 9,903,164 B2
(45) Date of Patent: Feb. 27, 2018

(54) DRILL BITS AND DRILLING APPARATUSES INCLUDING THE SAME

(71) Applicant: Dover BMCS Acquisition Corporation, Orem, UT (US)

(72) Inventor: E. Sean Cox, Spanish Fork, UT (US)

(73) Assignee: DOVER BMCS ACQUISITION CORPORATION, Orem, UT (US)

( * ) Notice: Subject to any disclaimer, the term of this patent is extended or adjusted under 35 U.S.C. 154(b) by 0 days.

(21) Appl. No.: 14/667,410

(22) Filed: Mar. 24, 2015

(65) Prior Publication Data

US 2015/0197990 A1 Jul. 16, 2015

Related U.S. Application Data

(63) Continuation of application No. 13/100,512, filed on May 4, 2011, now Pat. No. 9,010,464.

(51) Int. Cl.

| | |
|---|---|
| ***E21B 10/43*** | (2006.01) |
| ***E21B 10/573*** | (2006.01) |
| ***E21B 10/55*** | (2006.01) |
| ***E21B 10/567*** | (2006.01) |

(52) U.S. Cl.

CPC ..... *E21B 10/43* (2013.01); *E21B 10/55* (2013.01); *E21B 10/5673* (2013.01); *E21B 10/573* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,200,159 | A | 4/1980 | Peschel et al. | |
| 4,278,373 | A * | 7/1981 | Wolfe, III | B23B 27/1614 407/114 |
| 4,538,690 | A | 9/1985 | Short, Jr. | |
| 4,927,303 | A * | 5/1990 | Tsujimura | B23C 5/1027 407/42 |
| 5,383,526 | A * | 1/1995 | Brady | E21B 10/43 175/57 |
| 5,429,199 | A | 7/1995 | Sheirer et al. | |
| 6,044,920 | A | 4/2000 | Massa | |
| 6,302,224 | B1 | 10/2001 | Sherwood, Jr. | |
| 6,595,305 | B1 | 7/2003 | Dunn | |
| D514,131 | S | 1/2006 | Brady | |

(Continued)

*Primary Examiner* — David J Bagnell
*Assistant Examiner* — Ronald R Runyan
(74) *Attorney, Agent, or Firm* — Fisherbroyles, LLP

(57) ABSTRACT

A roof-bolt drill bit has a bit body rotatable about a central axis and at least one coupling pocket defined in the bit body. At least one coupling pocket is defined in the bit body, the at least one coupling pocket being defined by a pocket back surface, a first pocket side surface having a substantially planar surface extending from the pocket back surface, and a second pocket side surface having a substantially planar surface extending from the pocket back surface, the second pocket side surface being nonparallel to the first pocket side surface. The first pocket side surface extends at an angle of between approximately 45° and approximately 90° relative to the second pocket side surface and the first pocket side surface and the second pocket side surface are separated from one another.

20 Claims, 10 Drawing Sheets

(56) References Cited

U.S. PATENT DOCUMENTS

| | | | | |
|---|---|---|---|---|
| 2002/0195279 | A1* | 12/2002 | Bise | E21B 10/58<br>175/419 |
| 2005/0103533 | A1 | 5/2005 | Sherwood, Jr. et al. | |
| 2011/0284294 | A1* | 11/2011 | Cox | E21B 10/43<br>175/431 |

* cited by examiner

DRILL BITS AND DRILLING APPARATUSES INCLUDING THE SAME

REFERENCE TO RELATED APPLICATIONS

This application is a continuation of U.S. patent application Ser. No. 13/100,512 filed 4 May 2011, which is hereby incorporated by reference in its entirety.

BACKGROUND

Cutting elements are traditionally utilized for a variety of material removal processes, such as machining, cutting, and drilling. For example, tungsten carbide cutting elements have been used for machining metals and on drilling tools for drilling subterranean formations. Similarly, polycrystalline diamond compact (PDC) cutters have been used to machine metals (e.g., non-ferrous metals) and on subterranean drilling tools, such as drill bits, reamers, core bits, and other drilling tools.

Drill bit bodies to which cutting elements are attached are often formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body. Steel drill bit bodies may also be fabricated by casting or forging a steel part and then machining the part to have the desired topographic features.

In some situations, drill bits employing cutting elements may be used in subterranean mining to drill roof-support holes. For example, in underground mining operations, such as coal mining, tunnels must be formed underground. In order to make certain tunnels safe for use, the roofs of the tunnels must be supported in order to reduce the chances of a roof cave-in and/or to block various debris falling from the roof. In order to support a roof in a mine tunnel, boreholes are typically drilled into the roof using a drilling apparatus. The drilling apparatus typically includes a drill bit attached to a drilling rod (commonly referred to as a "drill steel"). Roof bolts are then inserted into the boreholes to support the roof and/or to anchor a support panel to the roof. The drilled boreholes may be filled with a hardenable resin prior to inserting the bolts, or the bolts may have self-expanding portions, in order to anchor the bolts to the roof.

Various types of cutting elements, such as PDC cutters, have been employed for drilling boreholes for roof bolts. Although other configurations are known in the art, PDC cutters often comprise a substantially cylindrical or semi-cylindrical diamond "table" formed on and bonded under high-pressure and high-temperature (HPHT) conditions to a supporting substrate, such as a cemented tungsten carbide (WC) substrate.

During drilling operations, heat may be generated in the cutting elements due to friction between the cutting elements and a mining formation being drilled. Additionally, the cutting elements may be subjected to various compressive, tensile, and shear stresses as the cutting elements are forced against rock material during drilling operations. The combination of stresses and/or heat generated during drilling may cause cutting elements to become dislodged from drill bits. For example, if a roof-bolt drill bit is used improperly, stresses and heat may weaken a braze joint holding a cutting element to a bit body, resulting in displacement of the cutting element from the bit body. Such problems may cause delays and increase expenses during drilling operations. Avoiding such delays may reduce unnecessary downtime and production losses, which may be particularly important during bolting operations in mine tunnels due to various safety hazards present in these environments.

SUMMARY

The instant disclosure is directed to exemplary cutting elements for roof-bolt drill bits. According to at least one embodiment, a roof-bolt drill bit may comprise a bit body rotatable about a central axis and at least one coupling pocket defined in the bit body. The at least one coupling pocket may be defined by a pocket back surface, a first pocket side surface comprising a substantially planar surface extending from the pocket back surface, and a second pocket side surface comprising a substantially planar surface extending from the pocket back surface, with the second pocket side surface being nonparallel to the first pocket side surface. At least one cutting element may be at least partially disposed in the at least one coupling pocket. The at least one cutting element may comprise a cutting face, an element back surface opposite the cutting face, with the element back surface abutting the pocket back surface, and an element side surface extending around an outer periphery of the cutting face. The element side surface may include a first element side surface and a second element side surface. At least one of the first element side surface and the second element side surface may comprise a substantially planar surface. The first element side surface may be adjacent to the first pocket side surface and the second element side surface may be adjacent to the second pocket side surface.

According to some embodiments, the first element side surface may comprise a substantially planar surface that is substantially parallel to the first pocket side surface and/or the second element side surface may comprise a substantially planar surface that is substantially parallel to the second pocket side surface. In at least one embodiment, the second element side surface may be arcuate and the second pocket side surface may extend tangentially relative to a region of the second element side surface contacting the second pocket side surface.

In certain embodiments, the at least one cutting element may further comprise a third element side surface extending between the first element side surface and the second element side surface. Additionally, the at least one coupling pocket may be further defined by a pocket transition region extending between the first pocket side surface and the second pocket side surface. In at least one embodiment, the third element side surface may comprise a substantially planar surface. In additional embodiments, the third element side surface may be arcuate. According to various embodiments, the pocket transition region may be arcuate.

According to at least one embodiment, the cutting element may further comprise a chamfer extending around a peripheral portion of the at least one cutting element between the cutting face and a portion of the element side surface. The at least one cutting element may comprise a superabrasive table (e.g., a polycrystalline diamond table) bonded to a substrate. According to additional embodiments, at least one fluid delivery port may be defined in the bit body.

According to certain embodiments, at least one debris opening and a vacuum hole extending from the at least one debris opening may be defined within the bit body. In some embodiments, a portion of the cutting element may be at least partially disposed in the at least one debris opening. In some embodiments, the at least one cutting element may comprise two cutting elements positioned circumferentially substantially 180° apart with substantially the same back rake angles and side rake angles. The at least one cutting element may be positioned with a back rake angle of between approximately 5° and approximately 45° and a side rake angle of between approximately 0° and approximately 20°.

The instant disclosure is also directed to roof-bolt drilling apparatuses. In at least one embodiment, a roof-bolt drilling apparatus may comprise a drill steel and a drill bit mounted to the drill steel. The drill bit may comprise a bit body rotatable about a central axis and at least one coupling pocket defined in the bit body. The at least one coupling pocket may be defined by a pocket back surface, a first pocket side surface comprising a substantially planar surface extending from the pocket back surface, and a second pocket side surface comprising a substantially planar surface extending from the pocket back surface, with the second pocket side surface being nonparallel to the first pocket side surface. At least one cutting element may be at least partially disposed in the at least one coupling pocket. The at least one cutting element may comprise a cutting face, an element back surface opposite the cutting face, with the element back surface abutting the pocket back surface, and an element side surface extending around an outer periphery of the cutting face. The element side surface may include a first element side surface and a second element side surface. At least one of the first element side surface and the second element side surface may comprise a substantially planar surface. The first element side surface may be adjacent to the first pocket side surface and the second element side surface may be adjacent to the second pocket side surface.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
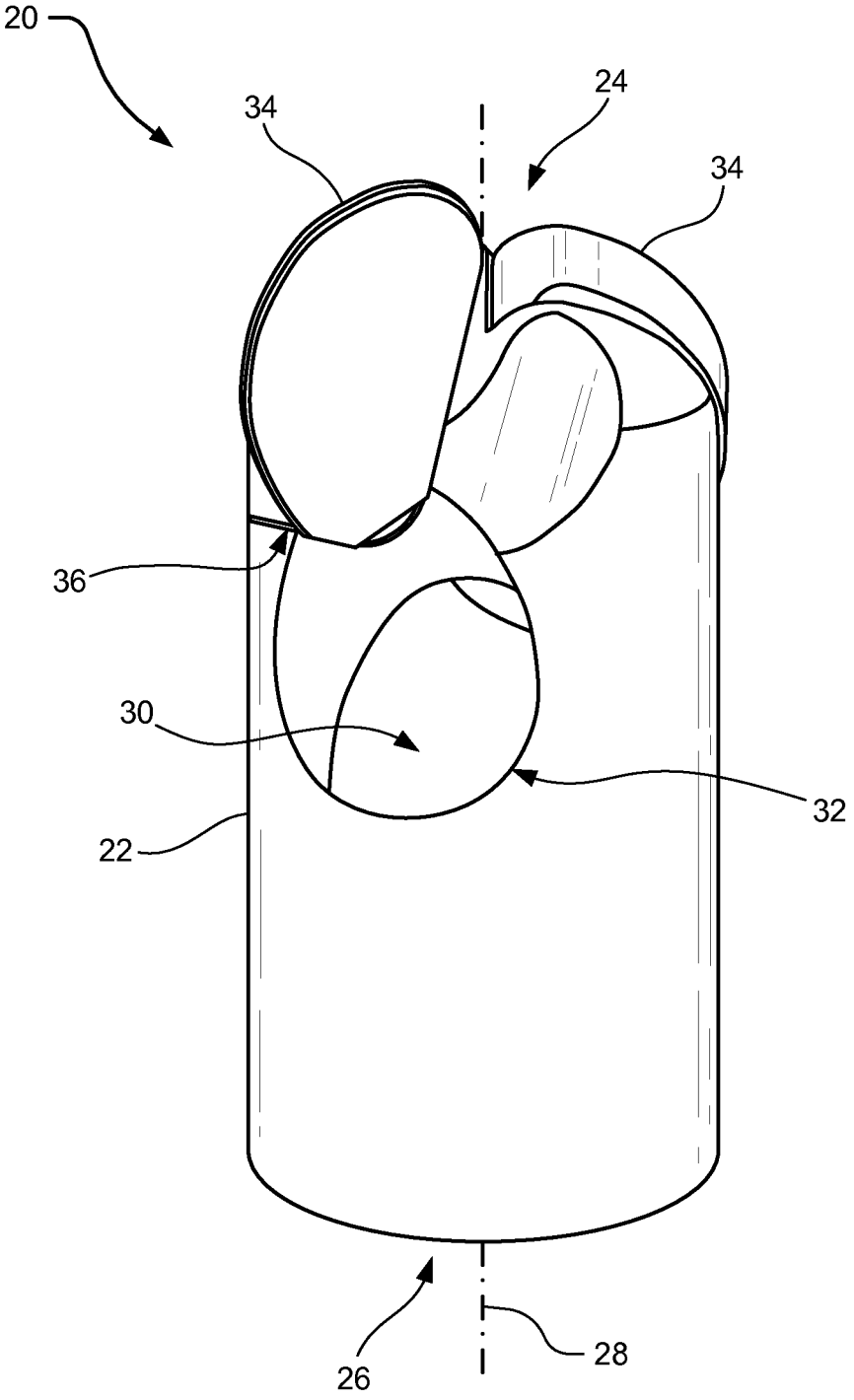
FIG. 1 is a perspective view of an exemplary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary drill bits and drilling apparatus for drilling formations in various environments. In at least one embodiment, a drill bit, such as a roof-bolt drill bit, may be coupled to a drill steel and rotated by a drilling apparatus configured to rotate the drill bit relative to a subterranean formation. Cutting elements for cutting the subterranean formation may be mounted to a bit body of the drill bit. For ease of use, the word "cutting," as used in this specification and claims, refers broadly to machining processes, drilling processes, boring processes, or any other material removal process.

FIG. 1 is a perspective view of a portion of an exemplary drill bit 20 according to at least one embodiment. Drill bit 20 may represent any type or form of earth-boring or drilling tool, including, for example, a roof-bolt drill bit. Drill bit 20 may be formed of any material or combination of materials, such as steel or molded tungsten carbide, without limitation. As illustrated FIG. 1, drill bit 20 may comprise a bit body 22 having a forward end 24, a rearward end 26, and a rotational axis 28. At least one cutting element 34 may be coupled to bit body 22. For example, as shown in FIG. 1, a plurality of cutting elements 34 may be coupled to forward end 24 of bit body 22. Cutting elements 34 may each be mounted and secured in corresponding coupling pockets 36 defined in bit body 22. The at least one cutting element may be positioned with a back rake angle of between approximately 5° and approximately 45° and a side rake angle of between approximately 0° and approximately 20°. In at least one embodiment, two cutting elements 34 may be positioned on bit body 22 circumferentially substantially 180° apart with substantially the same back rake angles and substantially the same side rake angles.

In some embodiments, an internal passage 30 may be defined within bit body 22. Internal passage 30 may extend from a rearward opening defined in rearward end 26 of bit body 22 to at least one side opening 32 defined in a side portion of bit body 22. In some embodiments, drill bit 20 may be configured for use in dry-drilling environments where cutting debris is removed from a borehole by applying a vacuum to internal passage 30. A vacuum applied to internal passage 30 may generate suction near side opening 32, thereby drawing cutting debris away from the borehole and through side opening 32. A vacuum applied to internal passage 30 may also facilitate cooling of cutting elements 34 and/or other portions of drill bit 20 through convective heat transfer as air and debris are drawn over and around cutting elements 34. In at least one embodiment, one side opening 32 may be defined in bit body 22 for each cutting element 34. For example, two side openings 32 may be defined in bit body 22, with the two side openings 32 corresponding to the two respective cutting elements 34 illustrated in FIG. 1. In some embodiments, a bit body of a drill bit may not include a debris opening for removing cutting debris (e.g., drill bit 220 illustrated in FIG. 11).

Figure 2:
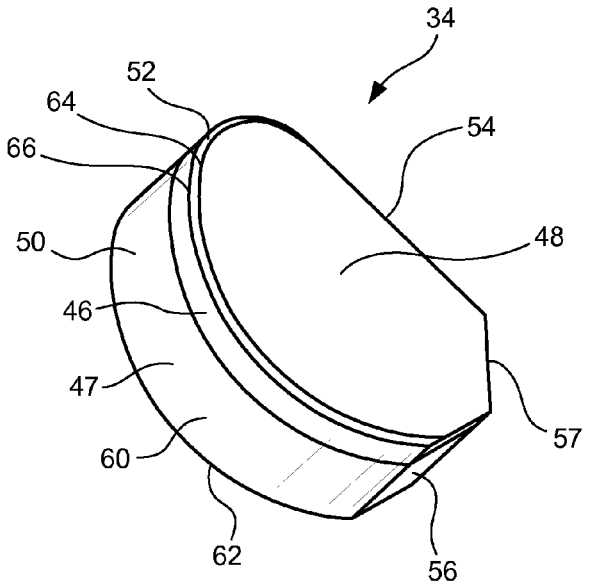
FIG. 2 is a perspective view of an exemplary cutting element according to at least one embodiment.

FIGS. 2 and 3 illustrate exemplary cutting elements according to various embodiments. FIG. 2 is a perspective view of a cutting element 34 that may be coupled to exemplary bit body 22 in FIG. 1. As shown in FIG. 2, cutting element 34 may comprise a layer or table 46 affixed to or formed upon a substrate 47. Table 46 may be formed of any material or combination of materials suitable for cutting subterranean formations, including, for example, a superhard or superabrasive material such as polycrystalline diamond (PCD). The words "superhard" or "superabrasive," as used herein, refer to any material having a hardness that is at least equal to a hardness of tungsten carbide. Substrate 47 may comprise any material or combination of materials capable of adequately supporting a superabrasive material during drilling of a subterranean formation, including, for example, cemented tungsten carbide.

In at least one embodiment, cutting element 34 may comprise a superhard PCD table 46 comprising polycrystalline diamond bonded to a substrate 47 comprising cobalt-cemented tungsten carbide. In at least one embodiment, after forming PCD table 46, a catalyst material (e.g., cobalt or nickel) may be at least partially removed from PCD table 46. A catalyst material may be removed from at least a portion of PCD table 46 using any suitable technique, such as, for example, acid leaching.

According to some embodiments, the PCD table 46 may be fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles, infiltrated from a metal-solvent catalyst foil or powder adjacent to the diamond particles, infiltrated from a metal-solvent catalyst present in a cemented carbide substrate, or combinations of the foregoing. The temperature of the HPHT process may be at least about 1000° C. (e.g., about 1200° C. to about 1600° C., about 1200° C. to about 1300° C., or about 1600° C. to about 2300° C.) and the pressure of the HPHT process may be at least 4.0 GPa (e.g., about 5.0 GPa to about 10.0 GPa, about 5.0 GPa to about 8.0 GPa, or about 7.5 GPa to about 9.0 GPa) for a time sufficient to bond the diamond particles to one another (e.g., via $sp^3$ bonding). The bonded diamond grains (e.g., $sp^3$-bonded diamond grains), so-formed by HPHT sintering the diamond particles, define interstitial regions with the metal-solvent catalyst disposed within the interstitial regions. The diamond particles may exhibit a selected diamond particle size distribution.

The as-sintered PCD body may be leached by immersion in an acid, such as aqua regia, nitric acid, hydrofluoric acid, or subjected to another suitable process to remove at least a portion of the metal-solvent catalyst from the interstitial regions of the PCD body and form the PCD table 46. For example, the as-sintered PCD body may be immersed in the acid for about 2 to about 7 days (e.g., about 3, 5, or 7 days) or for a few weeks (e.g., about 4 weeks) depending on the process employed. Even after leaching, a residual, detectable amount of the metal-solvent catalyst may be present in the at least partially leached PCD table 102. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may be at least partially removed by the selected leaching process or may be relatively unaffected by the selected leaching process.

The plurality of diamond particles sintered to form the PCD table 46 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes) without limitation.

As shown in FIG. 2, cutting element 34 may also comprise a cutting face 48 formed by table 46, an element side surface 50 formed by table 46 and substrate 47, and an element back surface 62 formed by substrate 47. Cutting face 48, element side surface 50, and element back surface 62 may be formed in any suitable shape, without limitation. According to various embodiments, cutting face 48 may have a partially arcuate periphery. In at least one embodiment, cutting face 48 may be substantially planar and element side surface 50 may comprise a partial-cylindrical and/or otherwise arcuate surface that is optionally perpendicular to cutting face 48. In some embodiments, as illustrated in FIG. 2, cutting face 48 may have a substantially semi-circular or partial-circular periphery that includes one or more rounded corner portions. Element back surface 62 may be, in some embodiments, substantially parallel to cutting face 48.

As illustrated in FIG. 2, cutting element 34 may comprise a chamfer 52 formed on the superabrasive table along at least a portion of a periphery of table 46 between cutting face 48 and element side surface 50. Table 46 may also include any other suitable surface shape between cutting face 48 and element side surface 50, including, without limitation, an arcuate surface (e.g., a radius), a sharp edge, multiple chamfers/radii, a honed edge, and/or combinations of the foregoing. Chamfer 52 may be configured to contact and/or cut a subterranean formation as drill bit 20 is rotated relative to the formation (as will be described in greater detail below in connection with FIG. 7). In at least one embodiment, the phrase "cutting edge" refers to an edge portion of cutting element 34 that is exposed to and/or in contact with a formation during drilling. In some examples, cutting element 34 may comprise one or more cutting edges, such as an edge 64 and/or or an edge 66. Edge 64 and/or edge 66 may be formed adjacent chamfer 52 and may be configured to be exposed to and/or in contact with a formation during drilling. In various embodiments, edge 64 may be formed at an intersection between cutting face 48 and chamfer 52 and edge 66 may be formed at an intersection between element side surface 50 and chamfer 52.

Element side surface 50 of cutting element 34 may comprise one or more surface portions. For example, as illustrated in FIG. 2, element side surface 50 may include a first element side surface portion 54, a second element side surface portion 56, and a third element side surface portion 57 extending between first element side surface portion 54 and second element side surface portion 56. According to some embodiments, at least one of first element side surface portion 54 and second element side surface portion 56 may comprise a substantially planar surface. As illustrated in FIG. 2, both first element side surface portion 54 and second element side surface portion 56 comprise substantially planar surfaces extending in nonparallel directions relative to each other. In at least one embodiment, at least one of first element side surface portion 54 and/or second element side surface portion 56 may be nonplanar (e.g., arcuate second element side surface portion 156 illustrated in FIGS. 3A and 3B).

Third element side surface portion 57 may comprise any suitable shape and configuration. For example, third element side surface portion 57 may comprise a substantially planar surface, as shown in FIG. 2. In at least one embodiment, third element side surface portion 57 may be nonplanar (e.g., arcuate third element side surface portion 157 illustrated in FIGS. 3A and 3B). Two or more of first element side surface portion 54, second element side surface portion 56, and third element side surface portion 57 may be configured to contact one or more corresponding surface portions defining coupling pocket 36 of bit body 22 (as will be described in greater detail below in connection with FIGS. 6 and 7).

In some embodiments, element side surface 50 may also comprise an arcuate side surface portion 60 extending along a peripheral portion of cutting element 34 from first element side surface portion 54 to second element side surface portion 56. According to at least one embodiment, arcuate side surface portion 60 may be formed adjacent chamfer 52. In certain embodiments, edge 66 may be formed at an intersection between arcuate side surface portion 60 and chamfer 52. At least a portion of arcuate side surface portion 60 may be configured to face generally outward from cutting element 34 (as will be described in greater detail below in connection with FIGS. 6 and 7).

Figure 3A:
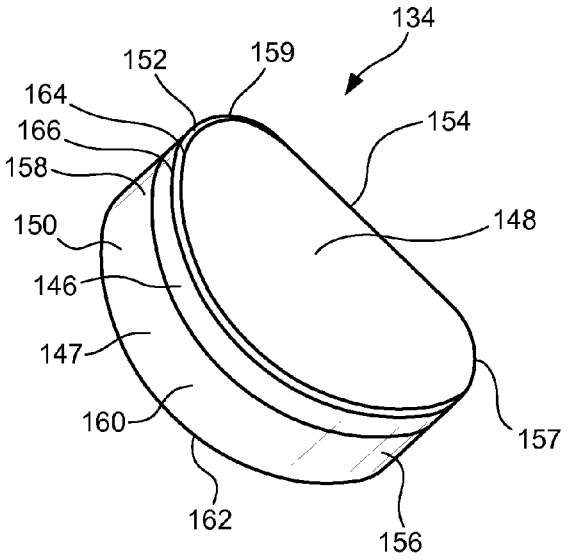
FIG. 3A is a perspective view of an exemplary cutting element according to at least one embodiment.
Figure 3B:
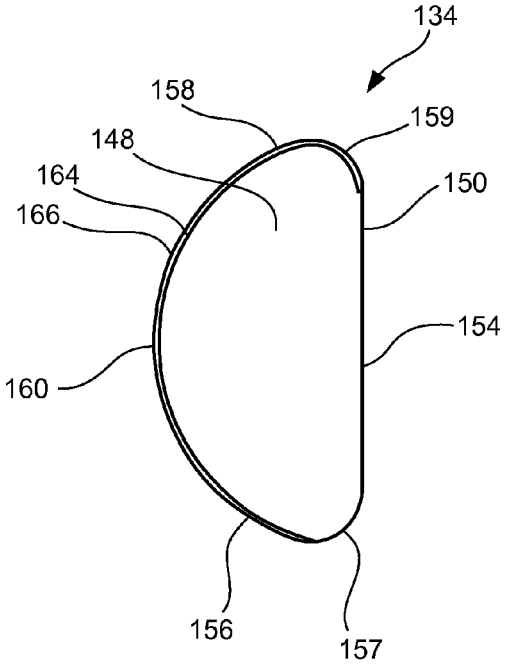
FIG. 3B is a front view of the exemplary cutting element illustrated in FIG. 3A.

FIGS. 3A and 3B show an exemplary cutting element 134. As shown in FIGS. 3A and 3B, cutting element 134 may comprise a table 146 affixed to and/or formed upon a substrate 147. Cutting element 134 may comprise a cutting face 148 formed by table 146, an element side surface 150 formed by table 146 and substrate 147, and an element back surface 162 formed by substrate 147. Cutting element 134 may also comprise a chamfer 152 formed on the superabrasive table along at least a portion of a periphery of table 146 between cutting face 148 and element side surface 150. An edge 164 and/or an edge 166 may be formed adjacent chamfer 152 and may be configured to be at least partially exposed to and/or at least partially in contact with a formation during drilling.

Element side surface 150 of cutting element 134 may include a first element side surface portion 154, a second element side surface portion 156, and a third element side surface portion 157 extending between first element side surface portion 154 and second element side surface portion 156. Element side surface 150 may also include a fourth element side surface portion 158 and a fifth element side surface portion 159 extending between first element side surface portion 154 and fourth element side surface portion 158. Element side surface 150 may also comprise an arcuate side surface portion 160 extending around a peripheral portion of cutting element 134 from second element side surface portion 156 to fourth element side surface portion 158. At least one of first element side surface portion 154, second element side surface portion 156, and fourth element side surface portion 158 may comprise a substantially planar surface. As illustrated in FIGS. 3A and 3B, first element side surface portion 154 may comprise a substantially planar surface, while second element side surface portion 156 and fourth element side surface portion 158 may each comprise a nonplanar surface portion. For example, second element side surface portion 156 and fourth element side surface portion 158 may be arcuate.

Third element side surface portion 157 and fifth element side surface portion 159 may each comprise any suitable shape and configuration. In some embodiments, third element side surface portion 157 and/or fifth element side surface portion 159 may each be nonplanar. For example, third element side surface portion 157 and/or fifth element side surface portion 159 may be arcuate. Two or more of first element side surface portion 154, second element side surface portion 156, third element side surface portion 157, fourth element side surface portion 158, and/or fifth element side surface portion 159 may be configured to contact one or more corresponding surface portions of a coupling pocket of a bit body (as will be described in greater detail below in connection with FIG. 9).

Figure 4:
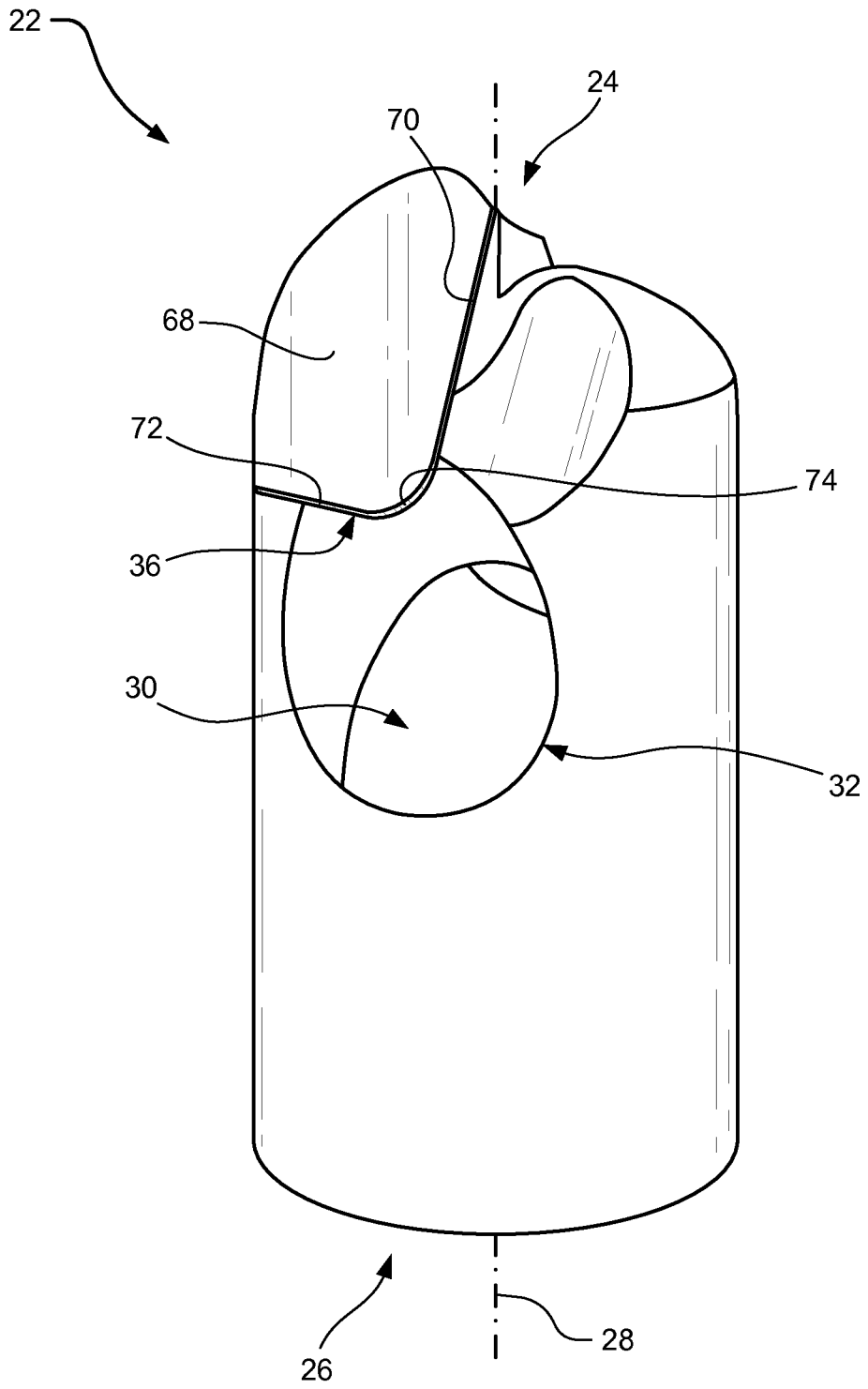
FIG. 4 is a perspective view of an exemplary bit body according to at least one embodiment.
Figure 5A:
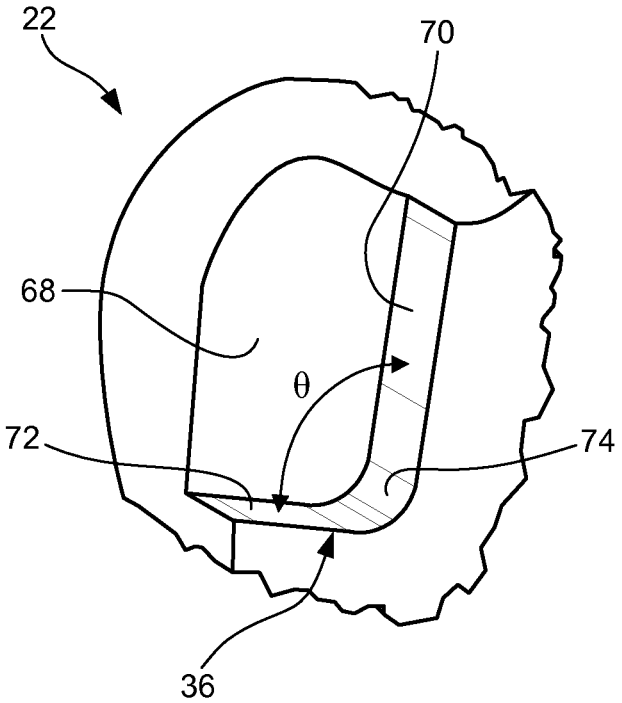
FIG. 5A is a perspective view of a portion of the exemplary bit body illustrated in FIG. 4 according to at least one embodiment.
Figure 5B:
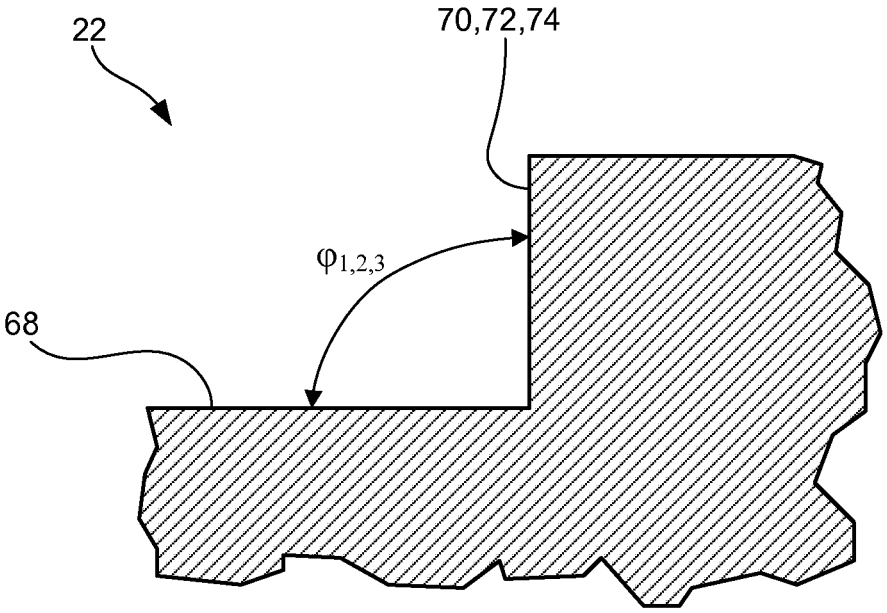
FIG. 5B is a partial cross-sectional view of a portion of the exemplary bit body illustrated in FIG. 4.

FIGS. 4, 5A, and 5B illustrate the exemplary bit body 22 shown in FIG. 1. FIG. 4 is a perspective view of bit body 22, FIG. 5A is a perspective view of a portion of bit body 22 that includes detail of coupling pocket 36, and FIG. 5B is a partial cross-sectional view of a portion of bit body 22. As shown in FIGS. 4, 5A, and 5B, at least one coupling pocket 36 may be defined in bit body 22 at or near forward end 24. Coupling pockets 36 may be formed to couple cutting elements 34 to bit body 22. At least a portion of each coupling pocket 36 may be configured to abut at least a portion of a corresponding cutting element 34 (as will be described in greater detail below in connection with FIGS. 6 and 7). In some embodiments, coupling pocket 36 may extend between forward end 24 and side opening 32 defined in bit body 22. Coupling pocket 36 may be formed in bit body 22 using any suitable technique, such as, for example, milling and/or molding, without limitation. According to at least one embodiment, coupling pocket 36 may be machined in bit body 22 using an end mill to remove material from bit body 22. For example, a continuous milling pass by a single end mill may be used to form a pocket back surface 68, a first pocket side surface 70, a second pocket side surface 72, and a pocket transition region 74 in bit body 22.

In various embodiments, coupling pocket 36 may be defined in cutting element 34 by pocket back surface 68 and one or more side surface portions. For example, coupling pocket may be defined by first pocket side surface 70 and second pocket side surface 72. Coupling pocket 36 may also be defined by pocket transition region 74 extending between first pocket side surface 70 and second pocket side surface 72. Pocket back surface 68, first pocket side surface 70, second pocket side surface 72, and pocket transition region 74 may comprise any suitable shape and configuration for abutting at least a portion of a cutting element 34 mounted to bit body 22.

According to certain embodiments, pocket back surface 68 may comprise a surface that is complementary to a back surface of cutting element 34 (e.g., element back surface 62 illustrated in FIG. 2). For example, pocket back surface 68 may comprise a substantially planar surface configured to support and/or abut the corresponding element back surface 62 of cutting element 34. First pocket side surface 70, second pocket side surface 72, and/or pocket transition region 74 may extend outward from pocket back surface 68. For example, as illustrated in FIG. 5B, first pocket side surface 70, second pocket side surface 72, and/or pocket transition region 74 may extend from pocket back surface 68 at, respectively, an angle $\phi_1$, an angle $\phi_2$, and/or an angle $\phi_3$ of between approximately 60° and approximately 120°. In at least one embodiment, first pocket side surface 70, second pocket side surface 72, and/or pocket transition region 74 may extend from pocket back surface 68 at, respectively, an angle $\phi_1$, an angle $\phi_2$, and/or an angle $\phi_3$ of approximately 90°.

First pocket side surface 70 and/or second pocket side surface 72 may comprise a substantially planar surface. First pocket side surface 70 and second pocket side surface 72 may extend in any suitable direction relative to each other and relative to bit body 22. In at least one embodiment, first pocket side surface 70 and/or second pocket side surface 72 may each extend at a respective angle that is nonparallel to rotational axis 28. First pocket side surface 70 may also be nonparallel to second pocket side surface 72. For example, as illustrated in FIG. 5A, first pocket side surface 70 may extend at an angle θ of between approximately 45° and approximately 135° relative to second pocket side surface 72.

Figure 6:
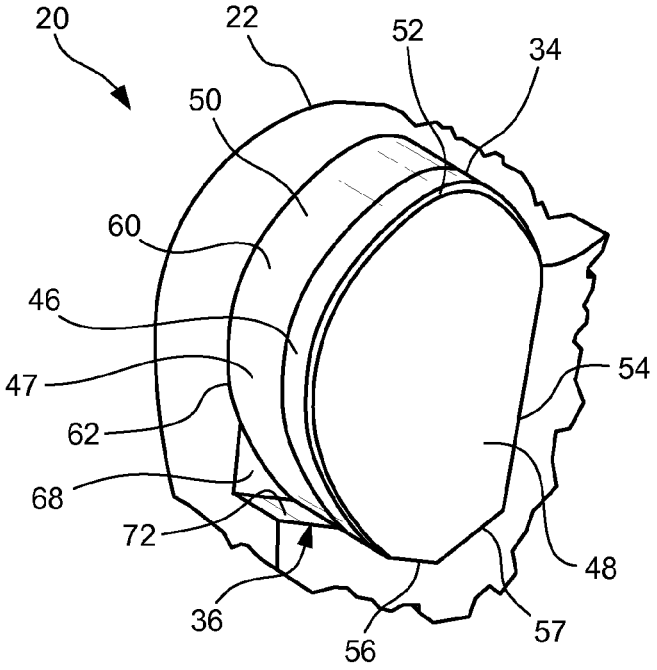
FIG. 6 is a perspective view of a portion of an exemplary drill bit that includes a cutting element coupled to the bit body illustrated in FIG. 5A according to at least one embodiment.
Figure 7:
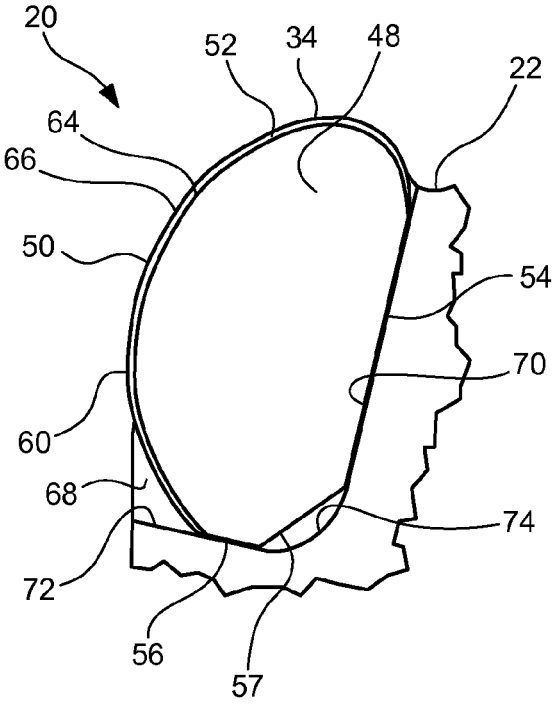
FIG. 7 is a front view of the portion of the exemplary drill bit illustrated in FIG. 6.

FIGS. 6 and 7 show a portion of the exemplary drill bit 20 illustrated in FIG. 1. As shown in FIGS. 6 and 7, cutting element 34 may be at least partially disposed in coupling pocket 36. At least a portion of cutting element 34 may be adjacent to one or more surface portions of bit body 22 defining coupling pocket 36. In some embodiments, portions of cutting element 34 may directly contact adjacent portions of bit body 22. In additional embodiments, a material, such as a brazing alloy, may be disposed between at least a portion of cutting element 34 and at least a portion of bit body 22.

Cutting element 34 may be coupled to bit body 22 using any suitable technique. For example, each cutting element 34 may be brazed, welded, soldered, threadedly coupled, and/or otherwise adhered and/or fastened to bit body 22. In at least one embodiment, element back surface 62 of cutting element 34 may be brazed to pocket back surface 68 of bit body 22. Any suitable brazing and/or or welding material and/or technique may be used to attach cutting element 34 to bit body 22. For example, cutting element 34 may be brazed to bit body 22 using a suitable braze material, such as, for example, an alloy comprising silver, tin, zinc, copper, palladium, nickel, and/or any other suitable metal compound. In other embodiments, cutting element 34 may be press fit or mechanically attached to bit body 22.

As shown in FIGS. 6 and 7, cutting element 34 may be disposed in and affixed to coupling pocket 36 such that at least a portion of element back surface 62 of cutting element 34 is positioned adjacent to and/or abutting pocket back surface 68 of bit body 22. Element back surface 62 may be substantially parallel to pocket back surface 68. Additionally, at least a portion of element side surface 50 may be positioned adjacent to and/or abutting at least a portion bit body 22. For example, first element side surface portion 54 may be positioned adjacent to and/or abutting first pocket side surface 70. As illustrated in FIG. 7, first element side surface portion 54 may extend in a direction substantially parallel to first pocket side surface 70 when cutting element 34 is coupled to bit body 22. In various embodiments, second element side surface portion 56 may be positioned adjacent to and/or abutting second pocket side surface 72 such that second element side surface portion 56 extends in a direction substantially parallel to second pocket side surface 72 when cutting element 34 is coupled to bit body 22.

Coupling pocket 36 may facilitate coupling of cutting element 34 to bit body 22 in a specified orientation. When cutting element 34 is disposed in coupling pocket 36 such that first element side surface portion 54 abuts first pocket side surface 70 and second element side surface portion 56 abuts second pocket side surface 72, at least a portion of arcuate side surface portion 60, chamfer 52, edge 64, and/or edge 66 may be selectively positioned relative to bit body 22. Accordingly, cutting element 34 may be positioned in coupling pocket 36 so that selected portions of cutting element 34 configured for contacting and cutting a subterranean formation, such as chamfer 52, edge 64, edge 66, arcuate side surface portion 60, and/or at least a portion of cutting face 48, are exposed to the subterranean formation during drilling. Additionally, portions of bit body 22 defining coupling pocket 36 may restrict one or more degrees of freedom of movement of cutting element 34 relative to bit body 22 during drilling (as will be described in greater detail below in connection with FIG. 8).

According to various embodiments, when cutting element 34 is disposed in coupling pocket 36 such that first element side surface portion 54 abuts first pocket side surface 70 and second element side surface portion 56 abuts second pocket side surface 72, a portion of cutting element 34 extending between first element side surface portion 54 and second element side surface portion 56, such as third element side surface portion 57, may not be congruent with or conform to a side surface portion of coupling pocket 36, such as pocket transition region 74. For example, third element side surface portion 57 may comprise a substantially planar surface extending between first element side surface portion 54 and second element side surface portion 56 in such a manner that third element side surface portion 57 does not conform to pocket transition region 74, which is arcuate. In additional embodiments, third element side surface portion 57 may comprise a nonplanar surface portion that does not conform to pocket transition region 74 when cutting element 34 is positioned in coupling pocket 36. Accordingly, a gap (e.g., varying in thickness) may be present between third element side surface portion 57 and pocket transition region 74.

Because third element side surface portion 57 of cutting element 34 does not conform to pocket transition region 74 of bit body 22, both first element side surface portion 54 and second element side surface portion 56 of cutting element 34 may abut portions of bit body 22 defining coupling pocket 36, such as first pocket side surface 70 and second pocket side surface 72. In other words, third element side surface portion 57 may not contact a portion of bit body 22 so as to allow first element side surface portion 54 and/or second element side surface portion 56 to closely abut corresponding portions of bit body 22, such as first pocket side surface 70 and/or second pocket side surface 72. Accordingly, cutting element 34 may be securely positioned in coupling pocket 36.

Figure 8:
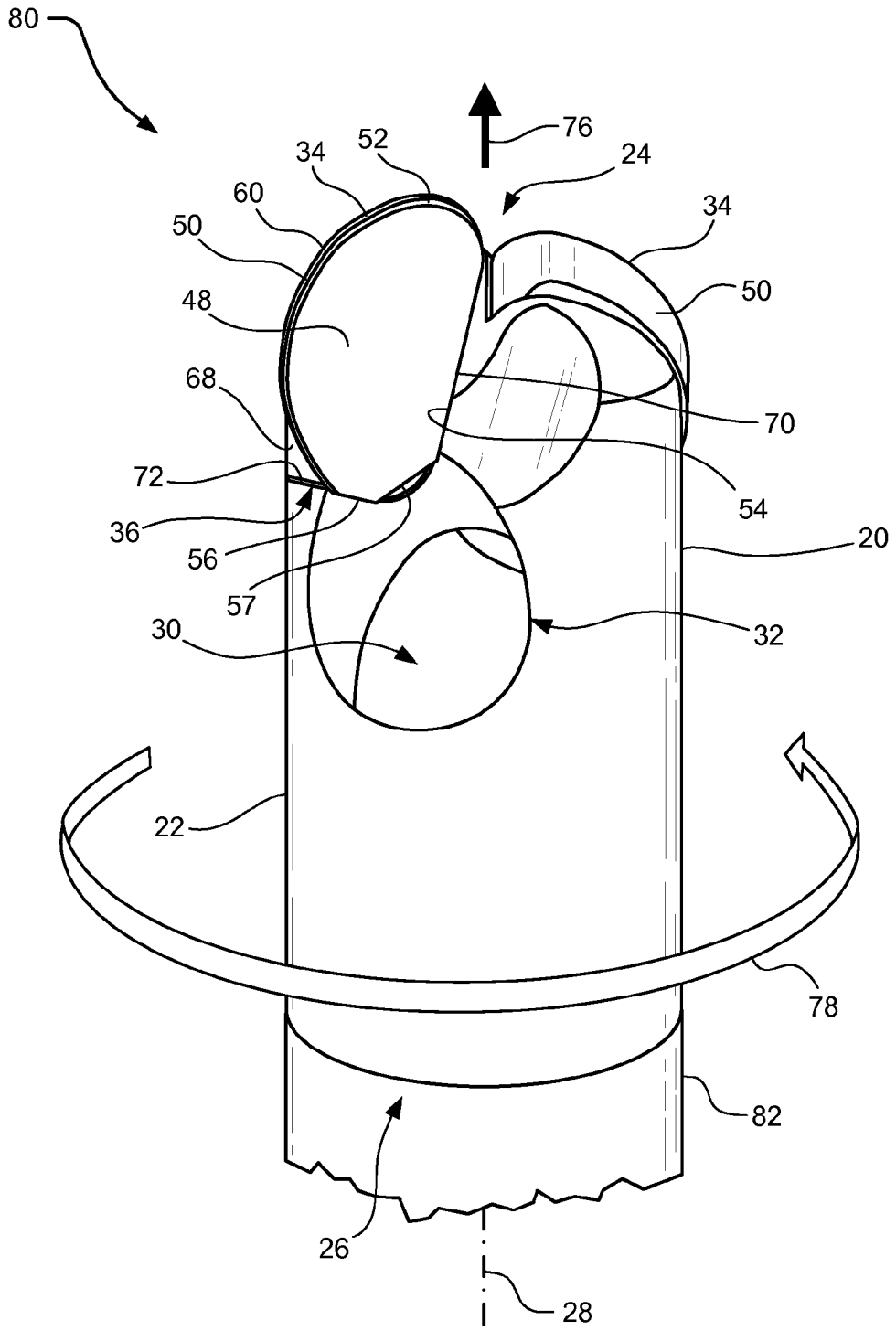
FIG. 8 is a perspective view of an exemplary drilling apparatus according to at least one embodiment.

FIG. 8 is a perspective view of a portion of an exemplary drilling apparatus 80 that includes the exemplary drill bit 20 illustrated in FIG. 1 according to at least one embodiment. Drilling apparatus 80 may comprise drill bit 20 coupled to a drill steel 82. As shown in FIG. 8, drill bit 20 may be rotated about rotational axis 28 in rotational direction 78 during a drilling operation, such as a subterranean drilling operation. For example, drill steel 82 may rotate drill bit 20 in rotational direction 78 during drilling of a borehole.

As shown in FIG. 8, rearward end 26 of drill bit 20 may be coupled to drill steel 82 by, for example, a threaded connection, a pin connection, and/or other suitable coupling. Drill steel 82 may comprise any suitable type of drilling rod or other suitable connection member configured to connect drill bit 20 to a drilling apparatus, without limitation. In some examples, drill steel 82 may comprise a substantially elongated shaft (e.g., a cylindrical shaft) having coupling surfaces corresponding to surfaces defined within drill bit 20. For example, drill steel 82 may comprise a hexagonal and/or threaded periphery corresponding to a hexagonal and/or threaded interior surface defined within drill bit 20. In some examples, drill steel 82 may comprise a pin connector corresponding to a pin hole and/or a recess defined within drill bit 20.

According to at least one embodiment, forces and/or torque may be applied by a drilling motor to drill bit 20 via drill steel 82, causing drill bit 20 to be forced against a subterranean formation in both rotational direction 78 and forward direction 76. As drill bit 20 is forced against the subterranean formation and rotated in rotational direction 78, cutting elements 34 may contact and cut into the subterranean formation, removing rock material from the formation in the form of rock cuttings and/or other debris. As shown in FIG. 8, each cutting element 34 may be positioned in a corresponding coupling pocket 36 so that portions of cutting element 34 configured for contacting and cutting a subterranean formation, such as chamfer 52, edges adjacent chamfer 52 (e.g., edge 64 and edge 66 illustrated in FIG. 2), arcuate side surface portion 60, and/or at least a portion of cutting face 48, are exposed to the subterranean formation during drilling. In at least one embodiment, cutting debris removed by cutting elements 34 may be drawn through internal passage 30 defined in bit body 22 by a vacuum applied to drill bit 20. According to some embodiments, drill steel 82 may comprise a hollow rod and a vacuum may be applied to a rearward end of drill steel 82 by a vacuum source. Cutting debris may be drawn by the vacuum through drill bit 20 and drill steel 82 toward the vacuum source.

According to at least one embodiment, forces may act on each cutting element 34 in generally sideward directions, rearward directions, radially inward directions, other directions, and/or combinations thereof relative to drill bit 20. Each cutting element 34 may be secured to bit body 22 (e.g., by brazing) so as to resist the various forces and stresses that cutting element 34 is subjected to during drilling, preventing separation of cutting elements 34 from bit body 22. For example, second pocket side surface 72 of bit body 22 may prevent movement of cutting element 34 in a generally axially rearward direction opposite axially forward direction 76. First pocket side surface 70 may prevent movement of cutting element 34 in a generally sideward and/or generally radially inward direction relative to bit body 22.

Additionally, first pocket side surface 70 and/or second pocket side surface 72 may prevent cutting element 34 from rotating within coupling pocket 36. For example, when cutting element 34 is positioned within coupling pocket 36 such that first element side surface portion 54 abuts first pocket side surface 70 and/or second element side surface portion 56 abuts second pocket side surface 72, cutting element 34 may be prevented from rotating within coupling pocket 36 about an axis, such as an axis that is generally perpendicular to pocket back surface 68 of bit body 22. Forces applied to cutting element 34 during drilling may be generated such that they are directed generally toward first pocket side surface 70 and/or second pocket side surface 72, which may further constrain cutting element 34 in coupling pocket 36 and may prevent rotational movement of cutting element 34 relative to coupling pocket 36. Accordingly, cutting element 34 may be secured to bit body 22 (e.g., by brazing) so as to resist various forces and stresses that cutting element 34 is subjected to during drilling, preventing separation of cutting element 34 from bit body 22.

Figure 9:
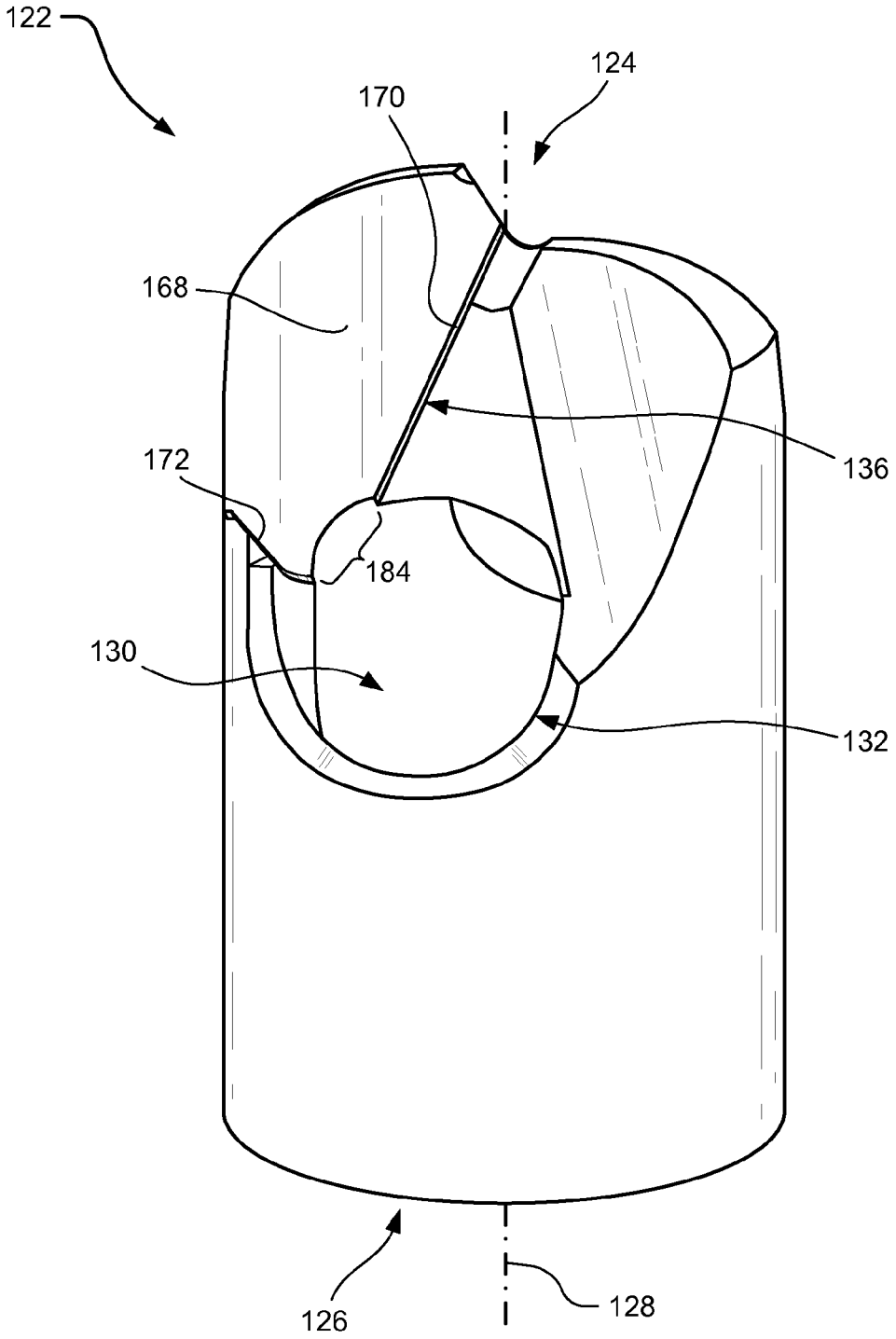
FIG. 9 is a perspective view of an exemplary bit body according to at least one embodiment.

FIGS. 9-12 show exemplary drill bits and bit bodies according to various embodiments. FIG. 9 is a perspective view of an exemplary bit body 122 according to at least one embodiment. Bit body 122 may have a forward end 124, a rearward end 126, and a rotational axis 128. In at least one embodiment, an internal passage 130 may be defined within bit body 122. Internal passage 130 may extend from a rearward opening defined in rearward end 126 of bit body 122 to at least one side opening 132 defined in a side portion of bit body 122. At least one coupling pocket 136 may be defined in bit body 122 at or near forward end 124. In some embodiments, coupling pocket 136 may extend between forward end 124 and side opening 132 defined in bit body 122.

In various embodiments, each coupling pocket 136 may be defined by a pocket back surface 168 and one or more side surface portions. For example, coupling pocket 136 may be defined by a first pocket side surface 170 and a second pocket side surface 172. First pocket side surface 170 and/or second pocket side surface 172 may comprise a substantially planar surface. First pocket side surface 170 and second pocket side surface 172 may extend in any suitable direction relative to each other and relative to bit body 122. According to at least one embodiment, first pocket side surface 170 may be nonparallel to second pocket side surface 172.

According to certain embodiments, a gap 184 may be defined between first pocket side surface 170 and second pocket side surface 172. For example, as illustrated in FIG. 9, gap 184 may extend between first pocket side surface 170 and second pocket side surface 172 at a region of bit body 122 where coupling pocket 136 intersects side opening 132. In some embodiments, gap 184 may be formed at a location other than a region intersecting side opening 132.

Figure 10:
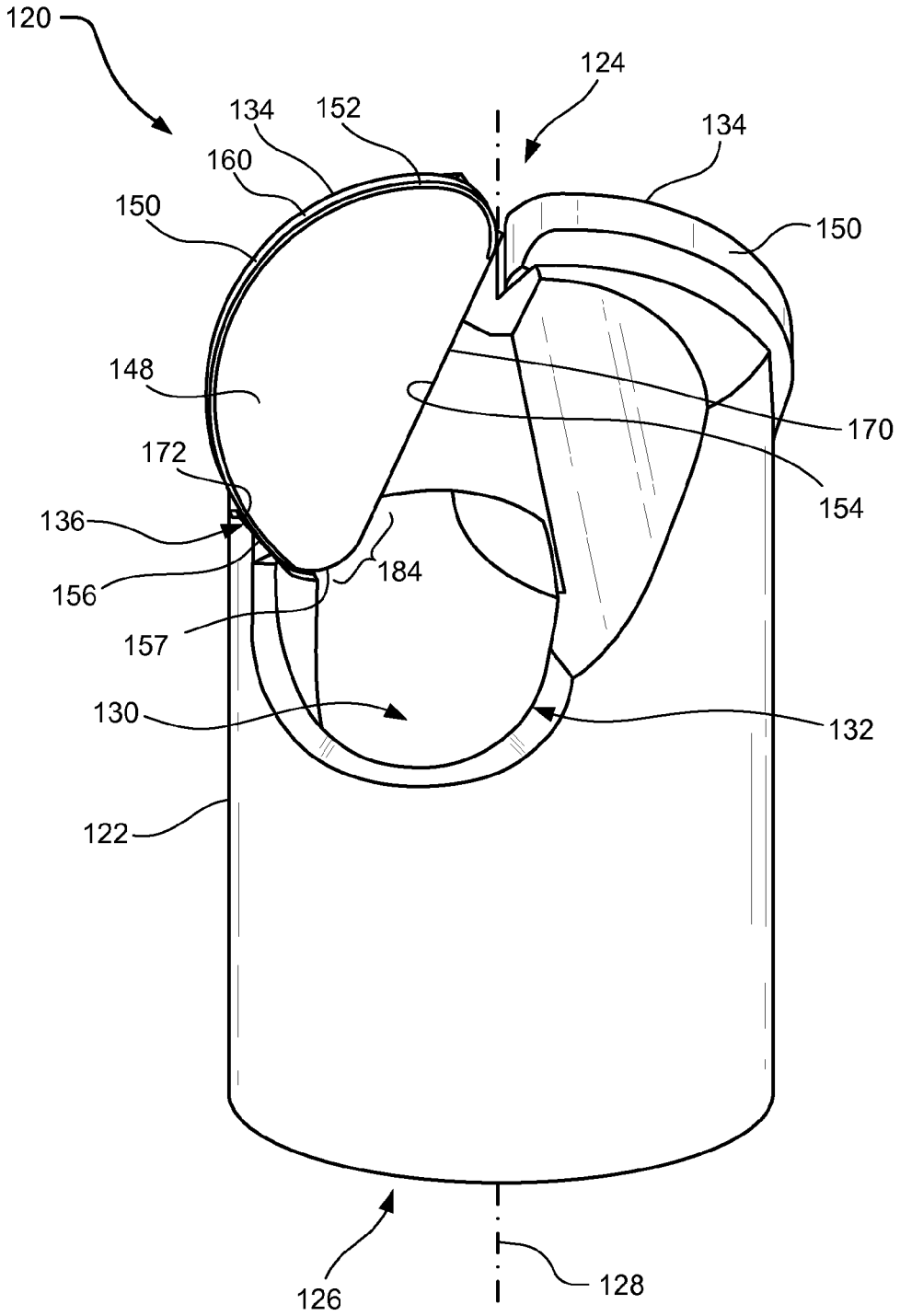
FIG. 10 is a perspective view of an exemplary drill bit that includes the exemplary bit body illustrated in FIG. 9 according to at least one embodiment.

FIG. 10 is a perspective view of an exemplary drill bit 120 comprising at least one cutting element 134 that is coupled to the bit body 122 illustrated in FIG. 9 according to at least one embodiment. As shown in FIG. 10, at least one cutting element 134 (e.g., cutting element 134 illustrated in FIGS. 3A and 3B) may be disposed in a corresponding coupling pocket 136 defined in bit body 122. At least a portion of cutting element 134 may be adjacent to and/or abutting one or more surface portions of bit body 122 defining coupling pocket 136.

As shown in FIG. 10, cutting element 134 may be disposed in and affixed to coupling pocket 136 such that at least a portion of an element back surface of cutting element 134 (e.g., element back surface 162 illustrated in FIG. 3A) is positioned adjacent to and/or abutting a back surface defining coupling pocket 136 (e.g., pocket back surface 168 illustrated in FIG. 9). Element back surface 162 may be substantially parallel to pocket back surface 168. Additionally, at least a portion of element side surface 150 may be positioned adjacent to and/or abutting at least a portion bit body 122. For example, first element side surface portion 154 may be positioned adjacent to and/or abutting first pocket side surface 170. In at least one embodiment, first element side surface portion 154 may extend in a direction substantially parallel to first pocket side surface 170 when cutting element 134 is coupled to bit body 122. In various embodiments, second element side surface portion 156 may be positioned adjacent to and/or abutting second pocket side surface 172 such that second pocket side surface 172 extends in a direction substantially tangential to a portion of second element side surface portion 156 contacting second pocket side surface 172 when cutting element 134 is coupled to bit body 122. For example, second element side surface portion 156 may comprise an arcuate surface portion and second pocket side surface 172 may comprise a substantially planar surface.

Cutting element 134 may be positioned in and affixed to coupling pocket 136 so that portions of cutting element 134 configured for contacting and cutting a subterranean formation, such as chamfer 152, edges adjacent chamfer 152 (e.g., edge 164 and/or edge 166 illustrated in FIGS. 3A and 3B), arcuate side surface portion 160, and/or at least a portion of cutting face 148, are exposed to the subterranean formation during drilling. Additionally, portions of bit body 122 defining coupling pocket 136 may restrict one or more degrees of freedom of movement of cutting element 134 relative to bit body 122 during drilling.

According to various embodiments, when cutting element 134 is disposed in coupling pocket 136 such that first element side surface portion 154 abuts first pocket side surface 170 and second element side surface portion 156 abuts second pocket side surface 172, at least a portion of cutting element 134 may extend through gap 184 defined between first pocket side surface 170 and second pocket side surface 172. For example, as shown in FIG. 10, a portion of cutting element 134 that includes third element side surface portion 157 may be disposed outside of coupling pocket 136 within and/or overlapping a portion of side opening 132. Accordingly, third element side surface portion 157 of cutting element 134 may not contact coupling pocket 136, and therefore, both first element side surface portion 154 and second element side surface portion 156 of cutting element 134 may be disposed closely abutting corresponding portions of bit body 122, such as first pocket side surface 170 and second pocket side surface 172. In other words, a portion of cutting element 134 extending between first element side surface portion 154 and second element side surface portion 156 may not contact a portion of bit body 122 so as to prevent first element side surface portion 154 and/or second element side surface portion 156 from closely abutting portions of bit body 122, such as first pocket side surface 170 and/or second pocket side surface 172. Accordingly, cutting element 134 may be securely positioned in coupling pocket 136 by brazing, for example.

In at least one embodiment, cutting element 134 may be secured to bit body 122 (e.g., by brazing) so as to resist the various forces and stresses that cutting element 134 is subjected to during drilling, preventing separation of cutting element 134 from bit body 122. For example, second pocket side surface 172 of bit body 122, in combination with first side pocket surface 170, may prevent movement of cutting element 134 in an axially rearward direction. First pocket side surface 170 may prevent movement of cutting element 134 in a generally sideward and/or radially inward direction relative to bit body 122.

Additionally, first pocket side surface 170 and/or second pocket side surface 172 may prevent cutting element 134 from rotating within coupling pocket 136. For example, when cutting element 134 is positioned within coupling pocket 136 such that first element side surface portion 154 abuts first pocket side surface 170 and/or second element side surface portion 156 abuts second pocket side surface 172, cutting element 134 may be prevented from rotating within coupling pocket 136 about an axis, such as an axis that is generally perpendicular to pocket back surface 168 of bit body 122. Forces applied to cutting element 134 during drilling may be directed such that cutting element 134 is supported by first pocket side surface 170 and/or second pocket side surface 172, which may further constrain cutting element 134 in coupling pocket 136 and may prevent rotational movement of cutting element 134 relative to coupling pocket 136. Accordingly, cutting element 134 may be secured to bit body 122 (e.g., by brazing) so as to resist various forces and stresses that cutting element 134 is subjected to during drilling, preventing separation of cutting element 134 from bit body 122.

Figure 11:
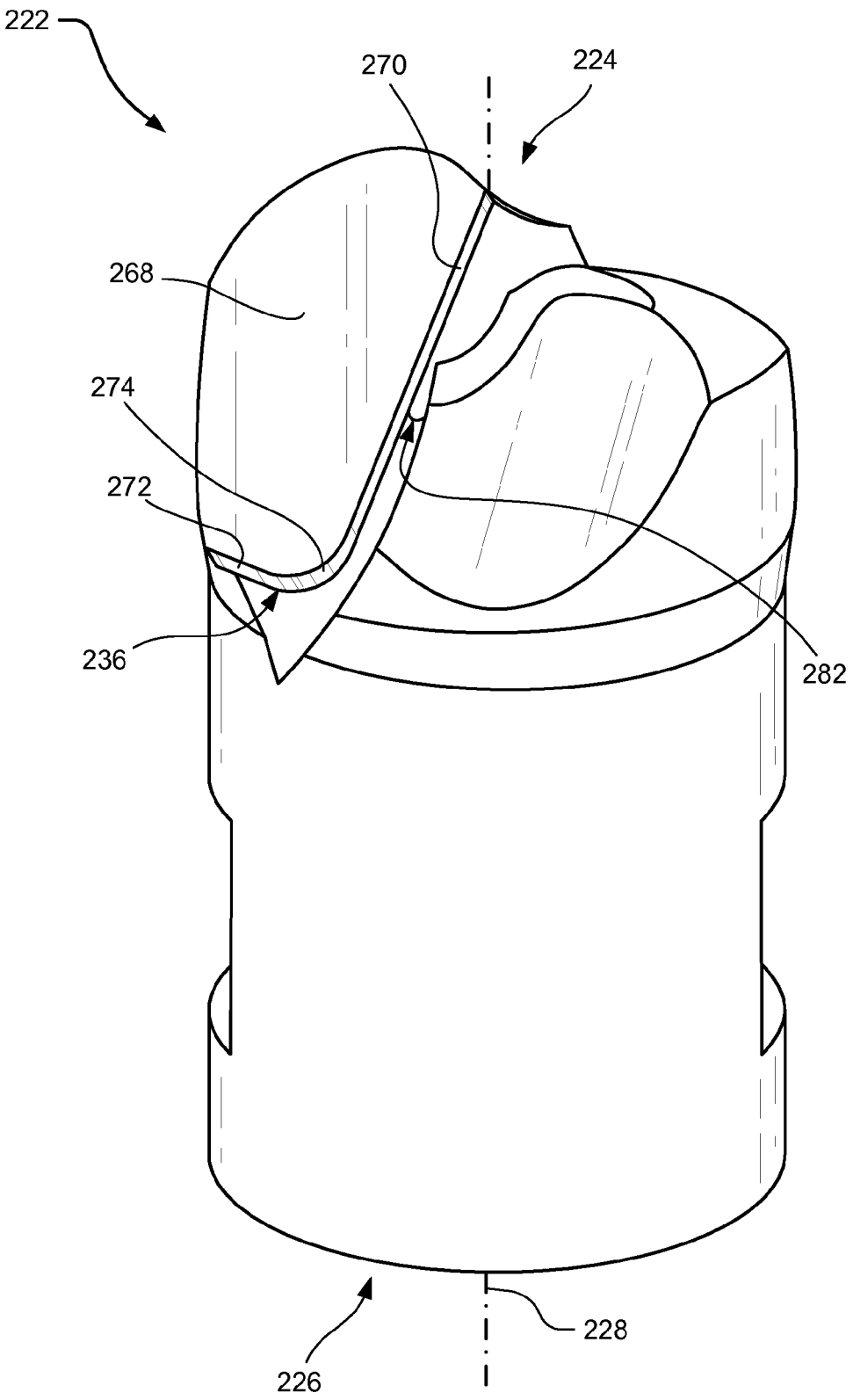
FIG. 11 is a perspective view of an exemplary bit body according to at least one embodiment.
Figure 12:
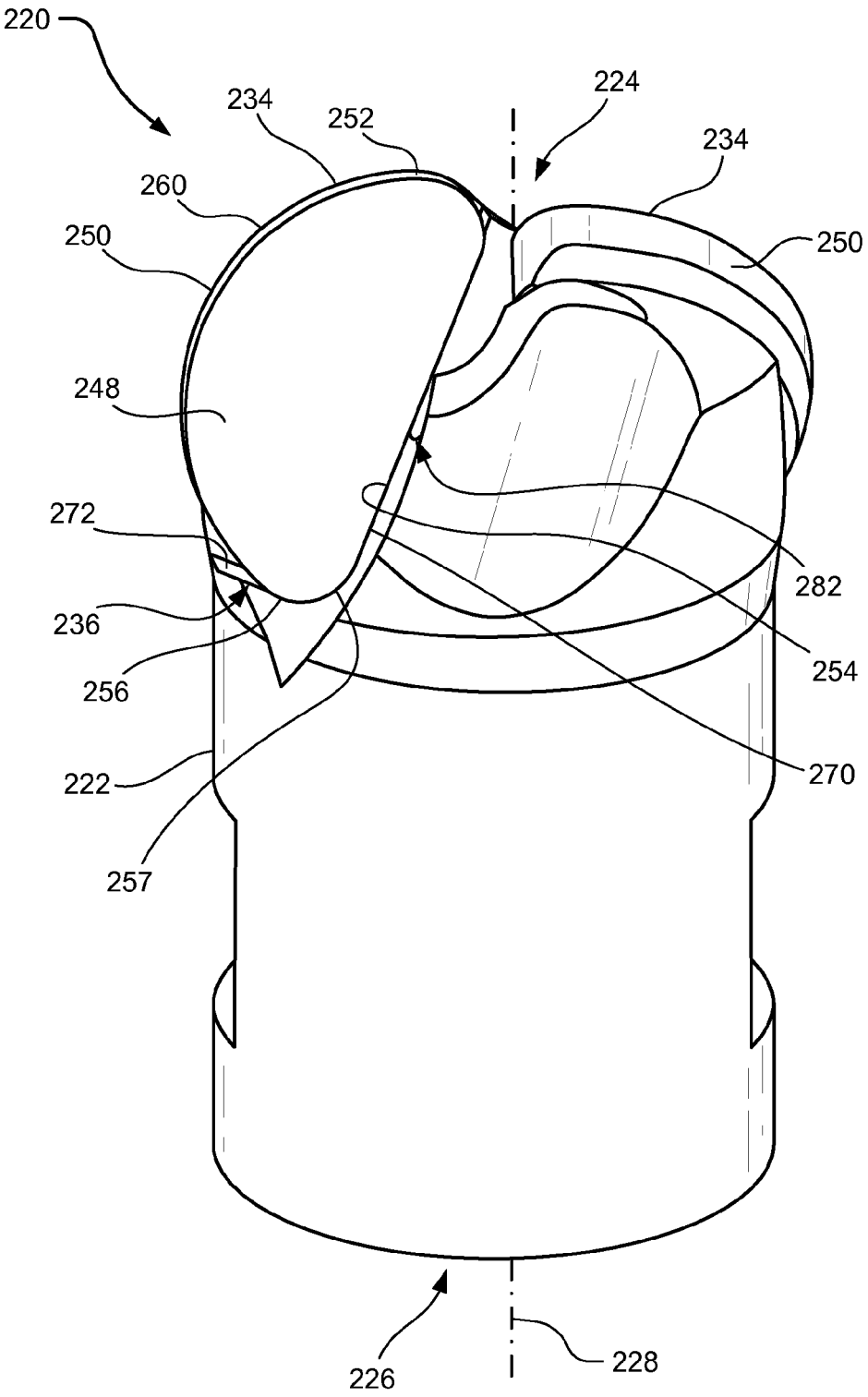
FIG. 12 is a perspective view of an exemplary drill bit that includes the exemplary bit body illustrated in FIG. 11 according to at least one embodiment.

FIG. 11 is a perspective view of an exemplary bit body 222 and FIG. 12 is a perspective view of an exemplary drill bit 220 that includes bit body 222 according to at least one embodiment. Drill bit 220 may be configured for use in wet-drilling environments where drilling fluids, such as drilling mud or water, are used to cool drill bit 220 and flush debris away from drill bit 220 and out of a borehole during drilling. In at least one example, one or more ports 282 for dispensing drilling fluids during cutting may be defined in forward and/or side portions of bit body 222. Drilling fluids may be conveyed to ports 282 through one or more internal passages extending through bit body 222.

Bit body 222 may have a forward end 224, a rearward end 226, and a rotational axis 228. At least one coupling pocket 236 may be defined in bit body 222 at or near forward end 224. Each coupling pocket 236 may be defined by a pocket back surface 268 and one or more side surface portions. For example, coupling pocket 236 may be defined by a first pocket side surface 270 and a second pocket side surface 272. First pocket side surface 270 and/or second pocket side surface 272 may comprise a substantially planar surface. First pocket side surface 270 and second pocket side surface 272 may extend in any suitable direction relative to each other and relative to bit body 222. According to at least one embodiment, first pocket side surface 270 may be nonparallel to second pocket side surface 272. In at least one embodiment, first pocket side surface 270 and second pocket side surface 272 may be perpendicular to one another. Coupling pocket 236 may also be defined by a pocket transition region 274 extending between first pocket side surface 270 and second pocket side surface 272.

As shown in FIG. 12, at least one cutting element 234 may be at least partially disposed in corresponding coupling pockets 236. Each cutting element 234 may comprise a cutting face 248, an element side surface 250, and an element back surface (e.g., element back surface 162 illustrated in FIG. 3A). Cutting element 234 may also comprise a chamfer 252 formed on the superabrasive table along at least a portion of a periphery of cutting element 234 between cutting face 248 and element side surface 250.

Element side surface 250 of cutting element 234 may include a first element side surface portion 254, a second element side surface portion 256, and a third element side surface portion 257 extending between first element side surface portion 254 and second element side surface portion 256. Element side surface 250 may also comprise an arcuate side surface portion 260 extending around a peripheral portion of cutting element 234 from first element side surface portion 254 to second element side surface portion 256. At least one of first element side surface portion 254 and second element side surface portion 256 may comprise a substantially planar surface. As illustrated in FIG. 12, first element side surface portion 254 may comprise a substantially planar surface and second element side surface portion 256 may comprise a nonplanar surface portion. For example, second element side surface portion 256 may comprise an arcuate surface portion configured to correspond to and/or abut second pocket side surface 272 of bit body 222.

At least a portion of each cutting element 234 may be adjacent to one or more surface portions of bit body 222 defining coupling pocket 236. In some embodiments, portions of cutting element 234 may directly contact adjacent portions of bit body 222. In additional embodiments, a material, such as a brazing alloy, may be disposed between at least a portion of cutting element 234 and at least a portion of bit body 222. Cutting element 234 may be disposed in and affixed to coupling pocket 236 such that at least a portion of a back surface of cutting element 234 (e.g., element back surface 162 illustrated in FIG. 3A) is positioned adjacent to and/or abutting pocket back surface 268 of bit body 222. Additionally, at least a portion of element side surface 250 may be positioned adjacent to and/or abutting at least a portion bit body 222.

As shown in FIGS. 11 and 12, first element side surface portion 254 may be positioned adjacent to and/or abutting first pocket side surface 270. First element side surface portion 254 may extend in a direction substantially parallel to first pocket side surface 270 when cutting element 234 is coupled to bit body 222. In various embodiments, second element side surface portion 256 may be positioned adjacent to and/or abutting second pocket side surface 272 such that second pocket side surface 272 extends in a direction substantially tangential to a portion of second element side surface portion 256 contacting second pocket side surface 272 when cutting element 234 is coupled to bit body 222. For example, second element side surface portion 256 may comprise an arcuate surface portion and second pocket side surface 272 may comprise a substantially planar surface. Third element side surface portion 257 may comprise any suitable shape and configuration. In some embodiments, third element side surface portion 257 may be nonplanar. For example, third element side surface portion 257 may be arcuate.

Cutting element 234 may be positioned in coupling pocket 236 so that portions of cutting element 234 configured for contacting and cutting a subterranean formation, such as chamfer 252, edges adjacent chamfer 252 (e.g., edge 164 and/or edge 166 illustrated in FIGS. 3A and 3B), arcuate side surface portion 260, and/or at least a portion of cutting face 248, are exposed to the subterranean formation during drilling. Additionally, portions of bit body 222 defining coupling pocket 236 may restrict one or more degrees of freedom of movement of cutting element 234 relative to bit body 222 during drilling. According to various embodiments, when cutting element 234 is disposed in coupling pocket 236 such that first element side surface portion 254 abuts first pocket side surface 270 and second element side surface portion 256 abuts second pocket side surface 272, third element side surface portion 257 may also optionally abut a portion of coupling pocket 236, such as pocket transition region 274.

In at least one embodiment, cutting element 234 may be secured to bit body 222 (e.g., by brazing) so as to resist the various forces and stresses that cutting element 234 is subjected to during drilling, preventing separation of cutting element 234 from bit body 222. For example, second pocket side surface 272 of bit body 222 may prevent movement of cutting element 234 in an axially rearward direction. First pocket side surface 270 of bit body 222 may prevent movement of cutting element 234 in a generally sideward and/or radially inward direction relative to bit body 222.

Additionally, first pocket side surface 270 and/or second pocket side surface 272 may prevent cutting element 234 from rotating within coupling pocket 236. For example, when cutting element 234 is positioned within coupling pocket 236 such that first element side surface portion 254 abuts first pocket side surface 270 and/or second element side surface portion 256 abuts second pocket side surface 272, cutting element 234 may be prevented from rotating within coupling pocket 236 about an axis, such as an axis that is generally perpendicular to pocket back surface 268 of bit body 222. Forces applied to cutting element 234 during drilling may be directed such that cutting element 234 is supported by first pocket side surface 270 and/or second pocket side surface 272, which may further constrain cutting element 234 in coupling pocket 236 and may prevent rotational movement of cutting element 234 relative to coupling pocket 236. Accordingly, cutting element 234 may be secured to bit body 222 (e.g., by brazing) so as to resist various forces and stresses that cutting element 234 is subjected to during drilling, preventing separation of cutting element 234 from bit body 222.

The preceding description has been provided to enable others skilled the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A roof-bolt drill bit, comprising:

a bit body rotatable about a central axis;

at least one coupling pocket defined in the bit body, the at least one coupling pocket being defined by:

a pocket back surface;

a first pocket side surface comprising a substantially planar surface extending from the pocket back surface;

a second pocket side surface comprising a substantially planar surface extending from the pocket back surface, the second pocket side surface being nonparallel to the first pocket side surface;

at least one debris opening defined in the bit body;

at least one cutting element at least partially disposed in the at least one coupling pocket, the at least one cutting element having an arcuate side surface peripherally extending around a majority of a cutting face of the at least one cutting element;

wherein:

the first pocket side surface extends at an angle of between approximately 45° and approximately 90° relative to the second pocket side surface;

the first pocket side surface and the second pocket side surface are separated from one another.

2. The roof-bolt drill bit of claim 1, wherein the first pocket side surface and the second pocket side surface are separated from one another by a pocket transition region.

3. The roof-bolt drill bit of claim 1, wherein:

the at least one coupling pocket is further defined by a pocket transition region extending between the first pocket side surface and the second pocket side surface.

4. The roof-bolt drill bit of claim 1, further comprising at least one fluid delivery port defined in the bit body.

5. The roof-bolt drill bit of claim 1, further comprising:

a vacuum hole defined in the bit body extending from the at least one debris opening.

6. The roof-bolt drill bit of claim 1, wherein the at least one cutting element comprises two cutting elements positioned circumferentially substantially 180° apart with substantially the same back rake angles and side rake angles.

7. The roof-bolt drill bit of claim 1, wherein the at least one cutting element comprises a superabrasive table bonded to a substrate.

8. The roof-bolt drill bit of claim 7, wherein the superabrasive table comprises a polycrystalline diamond material.

9. The roof-bolt drill bit of claim 1, wherein the at least one cutting element further comprises a substantially planar surface.

10. The roof-bolt drill bit of claim 1, wherein:

the at least one cutting element comprises:

a cutting face;

an element back surface abutting the pocket back surface;

an element side surface extending around an outer periphery of the cutting face, the element side surface comprising:

a first element side surface positioned adjacent to the first pocket side surface;

a second element side surface positioned adjacent to the second pocket side surface;

wherein the arcuate side surface extends from the first element side surface to the second element side surface.

11. The roof-bolt drill bit of claim 1, wherein the arcuate side surface of the at least one cutting element comprises a partial-cylindrical side surface.

12. The roof-bolt drill bit of claim 1, wherein:

the at least one debris opening is defined in a side portion of the bit body;

a portion of the at least one cutting element extends into the debris opening.

13. A roof-bolt drill bit, comprising:

a bit body rotatable about a central axis;

at least one coupling pocket defined in the bit body, the at least one coupling pocket being defined by:

a pocket back surface;

a first pocket side surface comprising a substantially planar surface extending from the pocket back surface;

a second pocket side surface extending from the pocket back surface, the second pocket side surface being separated from the first pocket side surface by a gap;

at least one debris opening defined in the bit body;

at least one cutting element at least partially disposed in the at least one coupling pocket, the at least one cutting element having an arcuate side surface;

wherein the at least one coupling pocket is open to the at least one debris opening via the gap separating the second pocket side surface from the first pocket side surface.

14. The roof-bolt drill bit of claim 13, further comprising a vacuum hole defined in the bit body extending from the at least one debris opening.

15. The roof-bolt drill bit of claim 13, wherein:

the at least one cutting element comprises:

a cutting face;

an element back surface abutting the pocket back surface;

an element side surface extending around an outer periphery of the cutting face, the element side surface comprising:

a first element side surface positioned adjacent to the first pocket side surface;

a second element side surface positioned adjacent to the second pocket side surface;

wherein the arcuate side surface extends from the first element side surface to the second element side surface.

16. The roof-bolt drill bit of claim 13, wherein a portion of the at least one cutting element extends through the gap separating the second pocket side surface from the first pocket side surface into the debris opening.

17. The roof-bolt drill bit of claim 13, wherein the at least one cutting element comprises a superabrasive table bonded to a substrate.

18. The roof-bolt drill bit of claim 17, wherein the superabrasive table comprises a polycrystalline diamond material.

19. The roof-bolt drill bit of claim 13, wherein the at least one cutting element further comprises a substantially planar surface.

20. The roof-bolt drill bit of claim 13, wherein the arcuate side surface of the at least one cutting element comprises a partial-cylindrical side surface.

* * * * *